US008758055B2

(12) United States Patent
McAlonis et al.

(10) Patent No.: US 8,758,055 B2
(45) Date of Patent: Jun. 24, 2014

(54) RF MODULE

(75) Inventors: Matthew Richard McAlonis, Elizabethtown, PA (US); Chong Hun Yi, Mechanicsburg, PA (US); Stephen Thomas Morley, Manheim, PA (US); Thomas Gregory Gartlan, Annville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 218 days.

(21) Appl. No.: 13/424,571

(22) Filed: Mar. 20, 2012

(65) Prior Publication Data

US 2013/0252464 A1 Sep. 26, 2013

(51) Int. Cl.
*H01R 13/648* (2006.01)

(52) U.S. Cl.
USPC ..... 439/607.01

(58) Field of Classification Search
USPC ..... 439/607.01, 63, 579, 541.5, 607.05, 439/607.17
See application file for complete search history.

(56) References Cited

U.S. PATENT DOCUMENTS

| | | | | |
|---|---|---|---|---|
| 5,250,137 | A * | 10/1993 | Arami et al. | 156/345.44 |
| 7,647,044 | B2 * | 1/2010 | Tamminen et al. | 455/424 |
| 7,665,998 | B2 * | 2/2010 | Kressner et al. | 439/63 |
| 7,824,219 | B2 * | 11/2010 | Wang | 439/607.27 |
| 7,828,598 | B2 * | 11/2010 | Wang | 439/607.27 |
| 2009/0197434 | A1 * | 8/2009 | Kressner et al. | 439/63 |
| 2013/0130547 | A1 * | 5/2013 | Simpson et al. | 439/607.01 |

* cited by examiner

*Primary Examiner* — Jean F Duverne

(57) ABSTRACT

An RF module includes a contact insert having a separable shielding body retaining an RF contact. The RF contact includes an RF mating tip connected to a signal tail. The mating tip and the signal tail extend out of shielding body. The shielding body includes first and second body members. The RF contact is positioned within the first body member and the second body member is removably secured to the second body member so that at least a portion of the RF contact is contained between the first and second body members. The RF module may also include a grounding block. The contact insert may be removably secured within the grounding block.

21 Claims, 11 Drawing Sheets

RF MODULE

BACKGROUND OF THE INVENTION

The subject matter herein relates generally to electrical connector assemblies.

Due to their favorable electrical characteristics, coaxial cables and connectors have grown in popularity for interconnecting electronic devices and peripheral systems. The connectors include an inner conductor coaxially disposed within an outer conductor, with a dielectric material separating the inner and outer conductors. A typical application utilizing coaxial cable connectors is a radio-frequency (RF) application having RF connectors designed to work at radio frequencies in the UHF and/or VHF range.

Typically, one or more connectors are mounted to a circuit board of an electronic device at an input/output port of the device and extend through an exterior housing of the device for connection with a coaxial cable connector. Some systems include a plurality of connectors held in a common housing. One particular example of a system that uses multiple connectors is a backplane module having a plurality of board mounted connectors with a separate mating assembly for mating with a daughtercard module. The mating assembly includes a housing holding a plurality of coaxial cable connectors, which are connected to the board mounted connectors by a cable assembly having lead end connectors individually terminated to corresponding board mounted connectors. The daughtercard module is mated with the mating assembly.

Typical backplane systems using RF connectors are not without disadvantages. For instance, each of the lead end connectors are typically individually and separately mated with the board connectors, which is time consuming and increases the cost of assembly. Additionally, the spacing between the housing of the mating assembly and the board connectors may be very small, such as less than one inch, making the assembly process difficult and time consuming. Manipulating a large number of connections for mating also increases time and complexity.

Additionally, coaxial cables occupy space within limited areas and volumes of various applications, such as within a computer system. For example, coaxial cables are routed to and from printed circuit boards and therefore need to be flexible. The coaxial cables are typically bent in order to provide proper routing between components. However, the bending may strain the mating interfaces of the cables. As such, the connections between the cables and reciprocal contacts may be out of position.

BRIEF DESCRIPTION OF THE INVENTION

Embodiments provide RF modules that may be mated with a backplane module in a cost effective, timely and reliable manner.

Certain embodiments provide an RF module that includes a grounding block having a front mating face, a rear wall, and a base. The front mating face has at least one contact mating cavity formed therein. The rear wall has an insert-retaining channel formed therethrough. The RF module may also include a contact insert removably secured within the grounding block. The contact insert includes a shielding body retaining an RF contact. The RF contact has an RF mating tip connected to a signal tail. The tip and the signal tail extend out of the shielding body. The contact insert is positioned within the grounding block through the rear wall such that the RF mating tip extends into the contact mating cavity and the signal tail extends from the base. The contact insert may be removed from the grounding block.

The shielding body may be separable. In an embodiment, the shielding body is separable about a central longitudinal plane. The shielding body may include first and second body members or halves. The RF contact is positioned within the first and second body halves, with the first and second body halves being snapably secured to one another. The first body half may be a symmetrical mirror image of the second body half.

The RF contact may include a center contact pin slidably connected to a lead, and a compressible coil spring biased within the contact insert. The compressible coil spring allows for the center contact pin to axially adjust with respect to the lead in response to varying mating forces. The center contact pin may be configured to axially adjust with respect to the lead while the lead remains fixed and stationary (such as when the lead is soldered to a printed circuit board).

The contact insert may be a right-angle contact insert. Alternatively, the contact insert may be an aligned linear contact insert, such as a stacked mezzanine connector.

The RF contact may be retained within the contact insert by a clasping ledge having an opening larger than a portion of the RF contact. A space between the RF contact and the clasping ledge allows the RF contact to radially shift within the contact insert.

The base may be configured to secure to a daughtercard and the mating tip may be configured to mate with a backplane contact without cables. Alternatively, the contact insert may be configured to connect to at least one cable.

Certain embodiments provide an RF module that includes a contact insert having a separable shielding body retaining an RF contact. The RF contact has an RF mating tip connected to a signal tail. The mating tip and the signal tail extend out of shielding body.

The shielding body includes separable first and second body members. The first body member and the second body member are removably secured to one another with at least a portion of the RF contact contained within an internal channel defined between the first and second body members.

The RF module may also include a grounding block. The contact insert may be removably secured within the grounding block.

The shielding body may be separable about a central longitudinal plane so that the first body member is a symmetrical mirror image of the second body member.

DETAILED DESCRIPTION OF THE INVENTION

Figure 1:
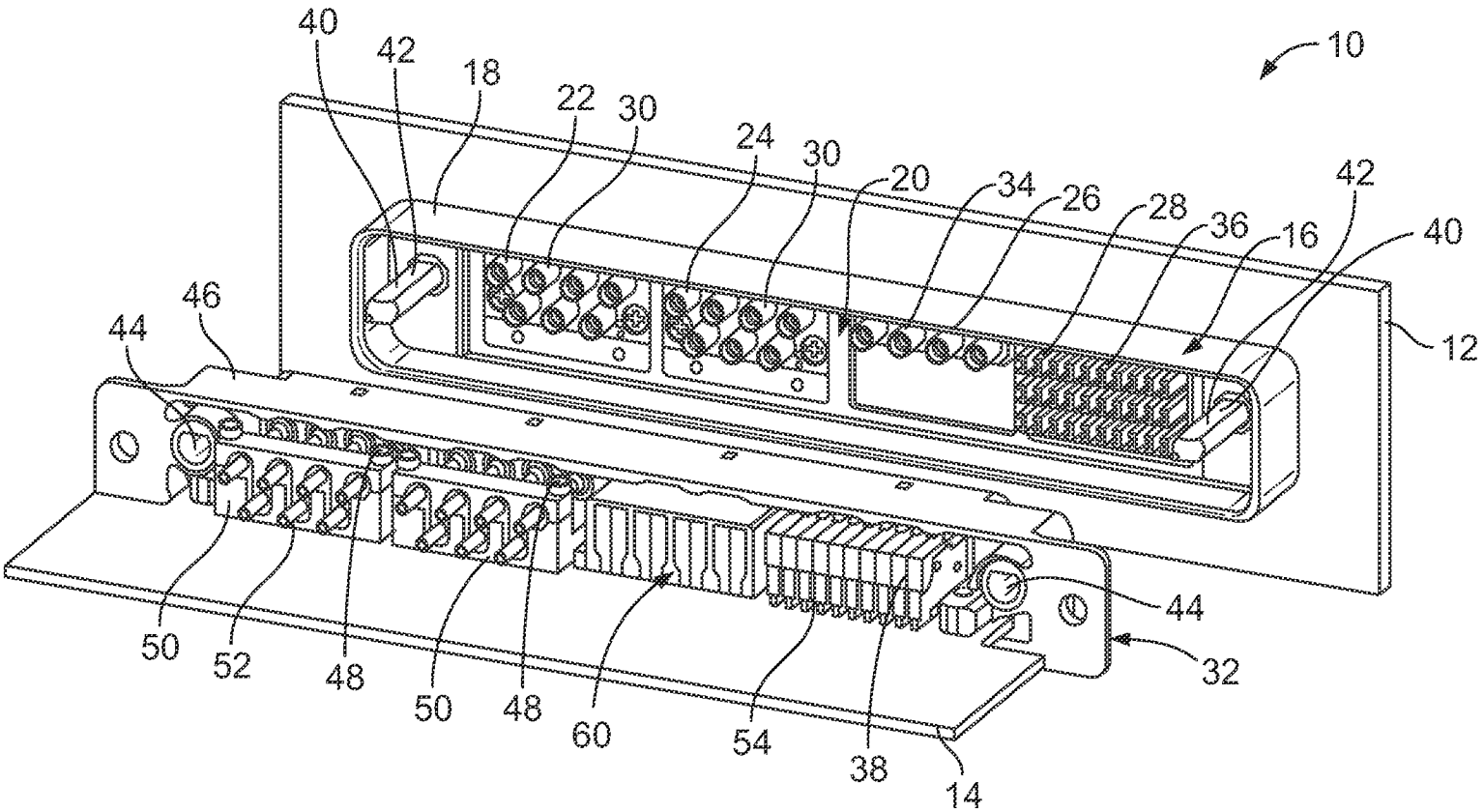
FIG. 1 illustrates a front isometric view of a disconnected electrical connector system, according to an embodiment.

FIG. 1 illustrates a front isometric view of a disconnected electrical connector system 10, according to an embodiment. The electrical connector system 10 may utilize coaxial cables and coaxial connectors for interconnecting electronic devices and peripheral systems. The electrical connector system 10 may be used to electrically connect a backplane or printed circuit board (PCB) 12 to a daughtercard or PCB 14.

A shroud 16 is secured to the backplane 12. The shroud 16 includes a circumferential upstanding wall 18 defining an internal cavity 20. A plurality of connecting interfaces 22, 24, 26, and 28 are contained within the internal cavity 20. The connecting interfaces 22 and 24 include a plurality of backplane contacts 30 configured to mate with cable-connecting interfaces of a module shell 32. Similarly, the connecting interface 26 includes a plurality of backplane contacts 34 configured to mate with RF connecting interfaces of the module shell 32. The connecting interface 28 includes a plurality of digital contacts 36 configured to mate with reciprocal digital contacts 38 secured to the module shell 32.

Alignment posts 40 are positioned at opposite ends of the internal cavity 20 and extend outwardly from the shroud 16. Each alignment post 40 may include a flattened area or surface 42 configured to ensure proper alignment with reciprocal apertures 44 of the module shell 32. That is, the alignment posts 40 and the reciprocal apertures 44 cooperate to ensure that the shroud 16 and the module shell 32 mate in a proper orientation with respect to one another.

The module shell 32 is secured to the daughtercard 14 and includes a plug housing 46 configured to mate into the internal cavity 20 of the shroud 16. The module shell 32 includes a plurality of cable-connecting modules 48 configured to mate with the connecting interfaces 22 and 24. The cable-connecting modules 48 may be RF cable-connecting modules that include strain-relief features or brackets 50 securing RF coaxial cables 52, such as shown and described in U.S. application Ser. No. 12/939,862, entitled "RF Module", filed on Nov. 4, 2010, which is hereby incorporated by reference in its entirety.

The module shell 32 may also include a digital module 54 having the plurality of digital contacts 38 configured to mate with the digital contacts 36 within the internal cavity 20 of the shroud 16.

The module shell 32 also includes an RF module 60 configured to mate with the backplane contacts 34 of the connecting interface 26 of the shroud 16. While the system 10 is shown with a plurality of modules, the system 10 may be configured such that each module is an RF module 60 configured to connect to a reciprocal interface, such as a connecting interface 26. That is, instead of using just one RF module 60, the system 10 may include four or more RF modules 60.

The RF module 60 is usable with any system that interconnects coaxial connectors and/or coaxial cables. The RF module 60 is particularly useful in systems that interconnect multiple coaxial connectors simultaneously. The electrical connector system 10 may be used within a rugged environment, such as in a military or aeronautical application in which the components of the electrical connector system 10 may be subject to vibration and/or shock.

Figure 2:
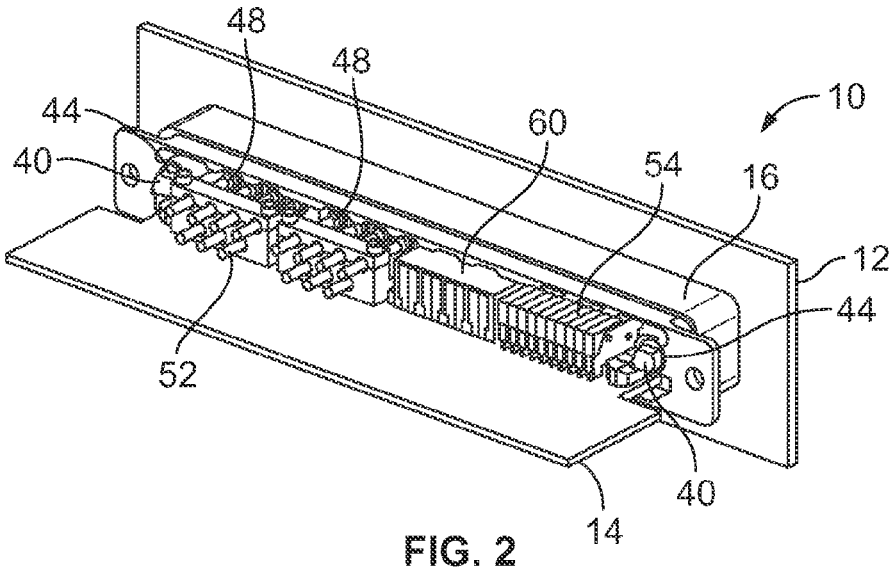
FIG. 2 illustrates a front isometric view of an electrical connector system, according to an embodiment.

FIG. 2 illustrates a front isometric view of the electrical connector system 10, according to an embodiment. In order to connect the shroud 16 and the module shell 32, the alignment posts 40 are aligned with the reciprocal apertures 44 of the module shell 32, thereby ensuring proper mating alignment and orientation. The module shell 32 is then moved into the internal cavity of the shroud 16. Distal ends of the alignment posts 40 extend through the apertures and the RF module 60, for example, mechanically and electrically mates with the backplane contacts 34 of the reciprocal interface 26. The other modules are similarly aligned and mated with their reciprocal interfaces within the internal cavity 20 of the shroud 16. In this manner, the backplane 12 is able to electrically communicate with the daughtercard 14.

Figure 3:
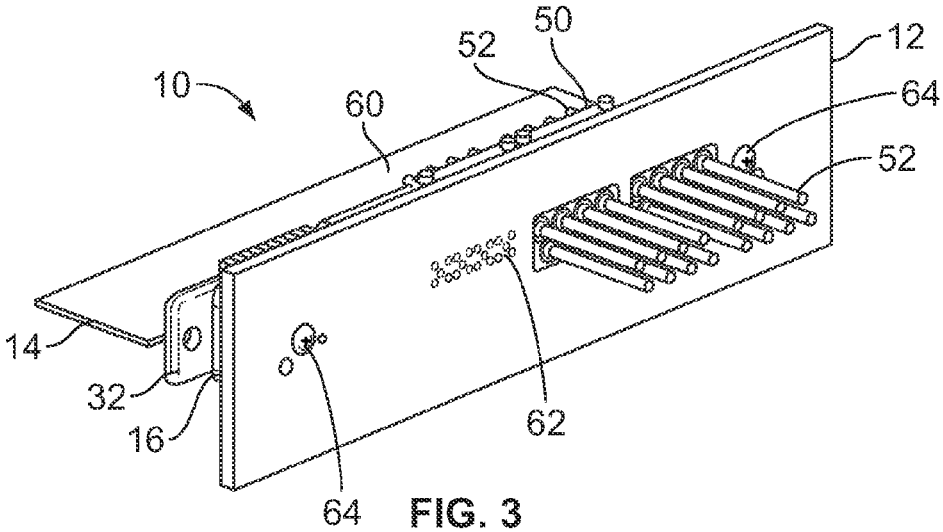
FIG. 3 illustrates a rear isometric view of an electrical connector system, according to an embodiment.
Figure 4:
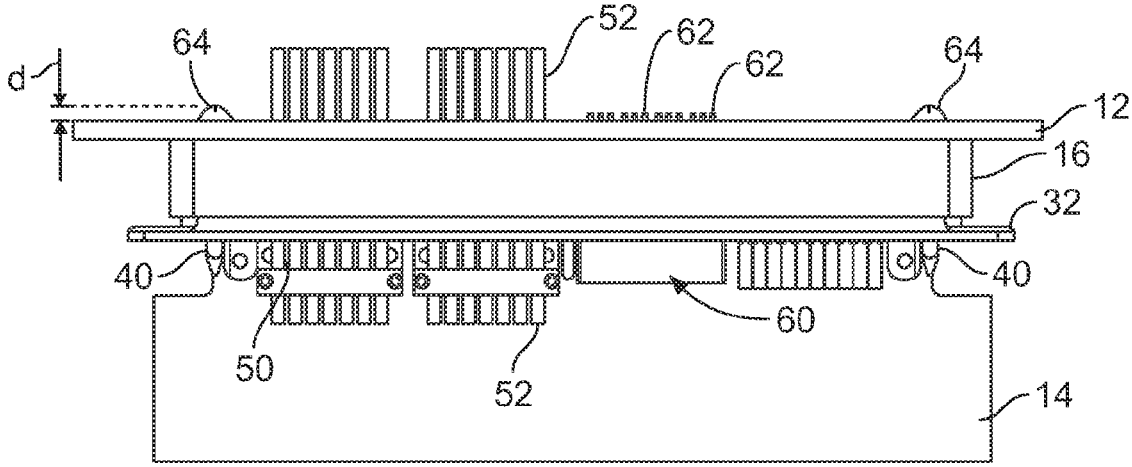
FIG. 4 illustrates a top view of an electrical connector system, according to an embodiment.

FIG. 3 illustrates a rear isometric view of the electrical connector system 10, according to an embodiment. FIG. 4 illustrates a top view of the electrical connector system 10, according to an embodiment. As shown in FIGS. 3 and 4, cables 52 extend out from the rear of the backplane 12. The cables 52 are electrically connected to the cables 52 extending from the cable-connecting modules 50. However, the RF module 60 connects to the backplane 12 such that only contact tails 62 of the backplane contacts 34 (shown in FIG. 1) slightly protrude out the rear of the backplane 12. Notably, the contact tails 62 may extend out the rear of the backplane 12 a distance that is less than or equal to a protruding distance d (shown in FIG. 4, in particular) of fastener heads 64 that secure the alignment posts 40 and/or the shroud 16 to the backplane 12. The RF module 60 may electrically connect the backplane 12 to the daughtercard 14 without the need for cables being routed and bent therebetween. Accordingly, the RF module 60 saves space because there is no need for cables to be routed to other connection points.

Figure 5:
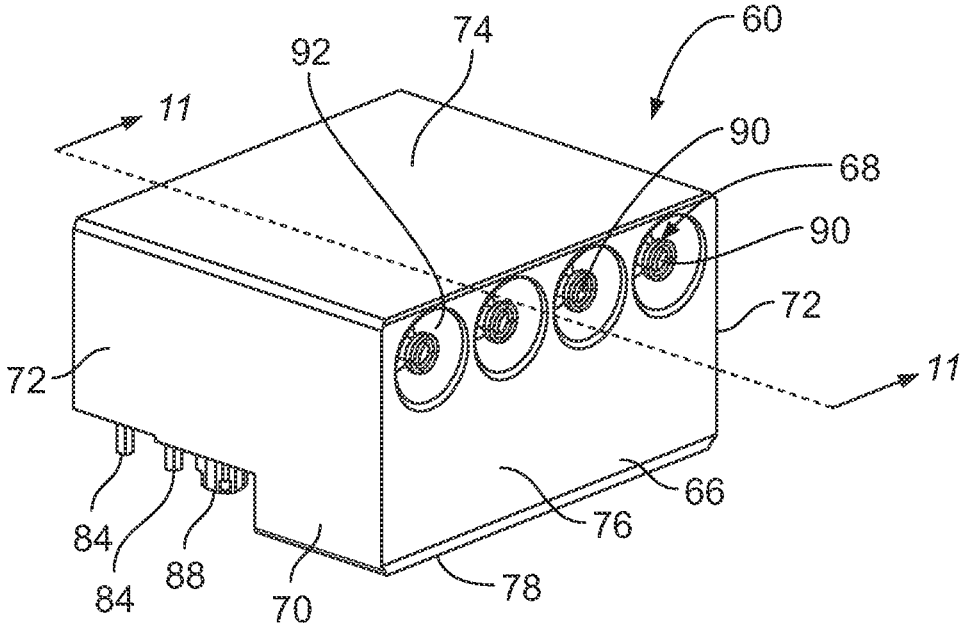
FIG. 5 illustrates a front isometric view of an RF module, according to an embodiment.
Figure 6:
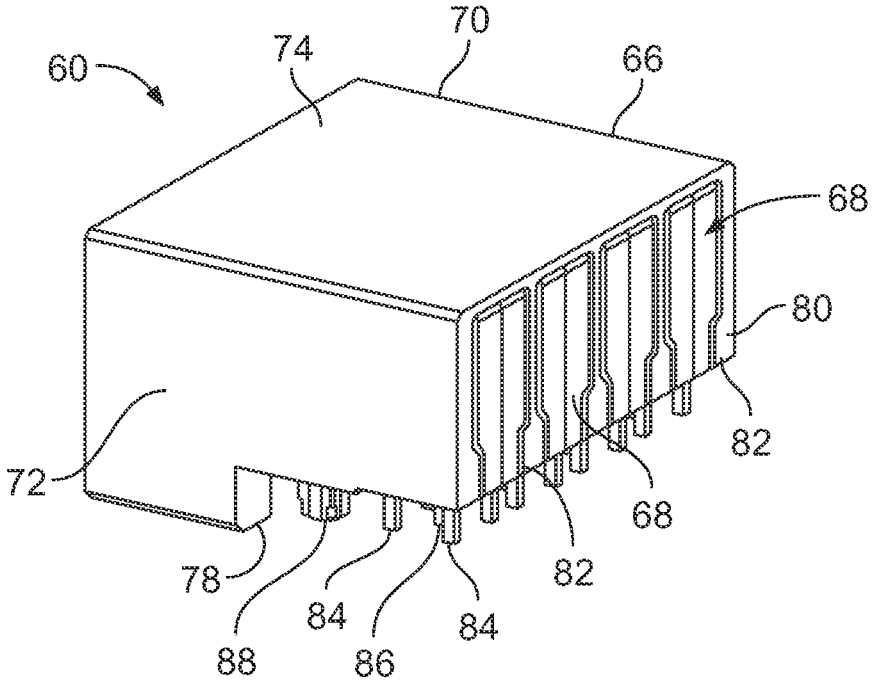
FIG. 6 illustrates a rear isometric view of an RF module, according to an embodiment.

FIGS. 5 and 6 illustrate front and rear isometric views, respectively, of the RF module 60, according to an embodiment. The RF module 60 includes a grounding block 66 that removably retains a plurality of contact inserts 68. While four contact inserts 68 are shown, more or less than four contact inserts 68 may be retained within the grounding block 66.

The grounding block 66 includes a main housing 70 having lateral walls 72 integrally formed with a top wall 74, a front mating face 76, a base 78, and a rear wall 80. The rear wall 80 includes a plurality of insert-receiving channels 82 configured to receive and removably retain the contact inserts 68. Each contact insert 68 includes a plurality of grounding tails 84 that extend downwardly from the base 78. Additionally, each contact insert 68 includes a signal tail 86 that extends downwardly from the base 78 between the grounding tails 84 of the contact insert 68. Further, the grounding block 66 includes a post or stud 88 that extends downwardly from the base 78. The stud 88, the grounding tails 84, and the signal tails 86 are configured to be received and retained within reciprocal through-holes or vias formed within the daughter-card 14 (shown in FIG. 1).

Each contact insert 68 includes an RF mating tip 90 that is exposed within a contact mating cavity 92 formed through the front mating face 76 of the grounding block 66. The RF mating tips 90 are configured to mate with reciprocal back-plane contacts 34 (shown in FIG. 1) extending from the shroud 16 (shown in FIG. 1) within the contact mating cavities 92. As shown, the contact mating cavities 92 are generally circular recessed areas that provide enough clearance for the mating tips 90 to mate with counterpart backplane contacts 34 (shown in FIG. 1). Optionally, the mating cavities 92 may be various other shapes and sizes that provide enough room for the mating tips 90 to mate with the backplane contacts 34.

The grounding block 66 is grounded to the daughtercard 14 (shown in FIG. 1) and is configured to isolate the signals of each contact insert 68. Thus, the grounding block 66 prevents cross-talk and interference between neighboring contact inserts 68. Additionally, the grounding tails 84 also shield the central signal tails 86 (each of which is surrounded by four grounding tails 84) from one another.

Figure 7:
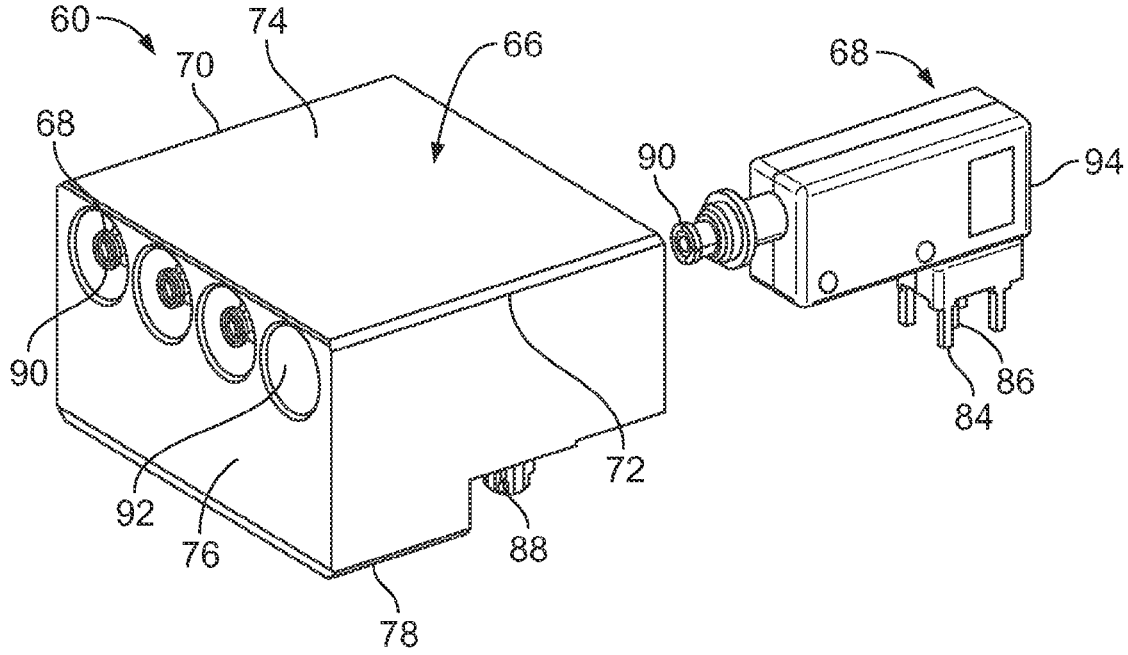
FIG. 7 illustrates a front isometric view of an RF module with a contact insert removed, according to an embodiment.
Figure 8:
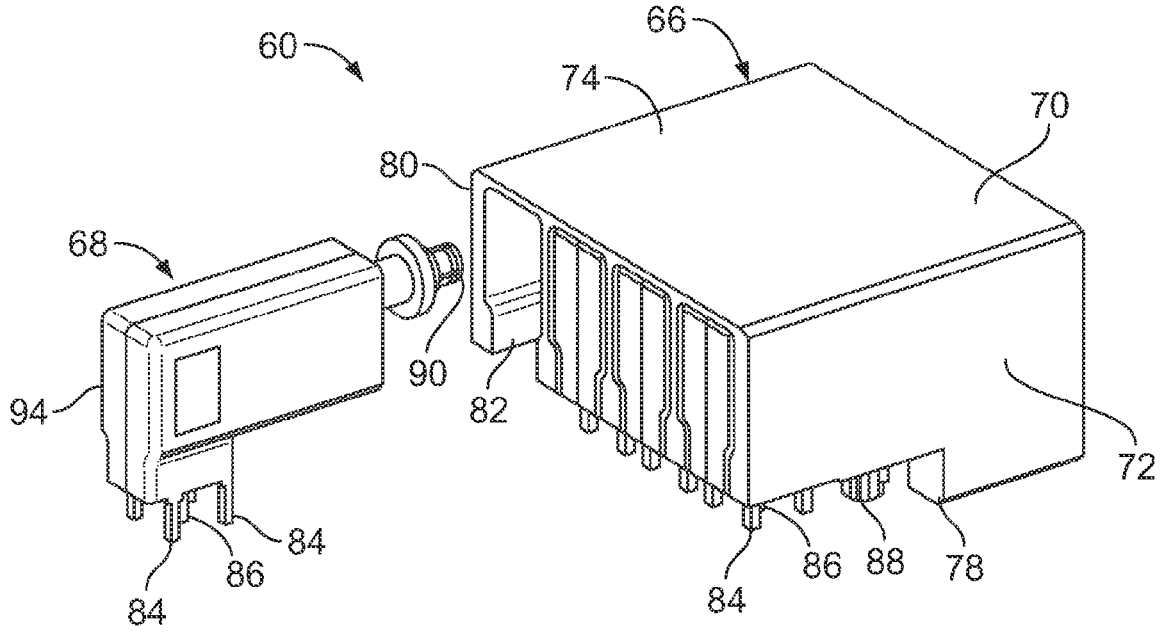
FIG. 8 illustrates a rear isometric view of an RF module with a contact insert removed, according to an embodiment.

FIGS. 7 and 8 illustrate front and rear isometric views, respectively, of the RF module 60 with a contact insert 68 removed, according to an embodiment. Referring to FIGS. 7 and 8, each contact insert 68 may be removed from the grounding block 66. The contact inserts 68 are interchangeable. Thus, if a contact insert 68 is malfunctioning, the malfunctioning contact insert 68 may be removed and another contact insert 68 inserted in its place. As shown in FIG. 8, in particular, the insert-receiving channels 82 are formed through the rear wall 80 and are configured to receive and removably retain the contact inserts so that the RF mating tips 90 extend into the contact mating cavities 92 (shown in FIG. 7) and the grounding tails 84 and signal tails 86 downwardly from the base 78 of the grounding block 66. For example, each contact insert 68 may be snapably, latchably, or otherwise removably secured within a respective insert-receiving channel 82. The insert-receiving channel 82 may include spring members that spring-bias the contact inserts 68 therein.

Figure 9:
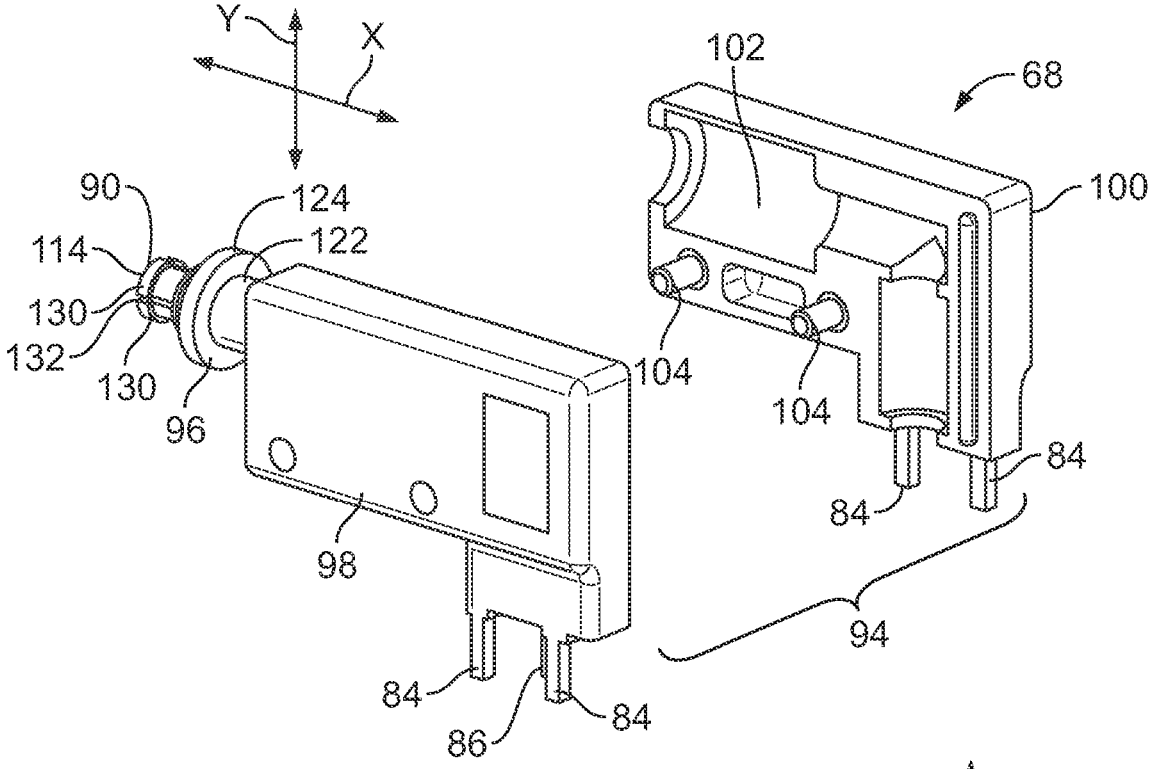
FIG. 9 illustrates a partially-exploded view of a contact insert from a first side, according to an embodiment.
Figure 10:
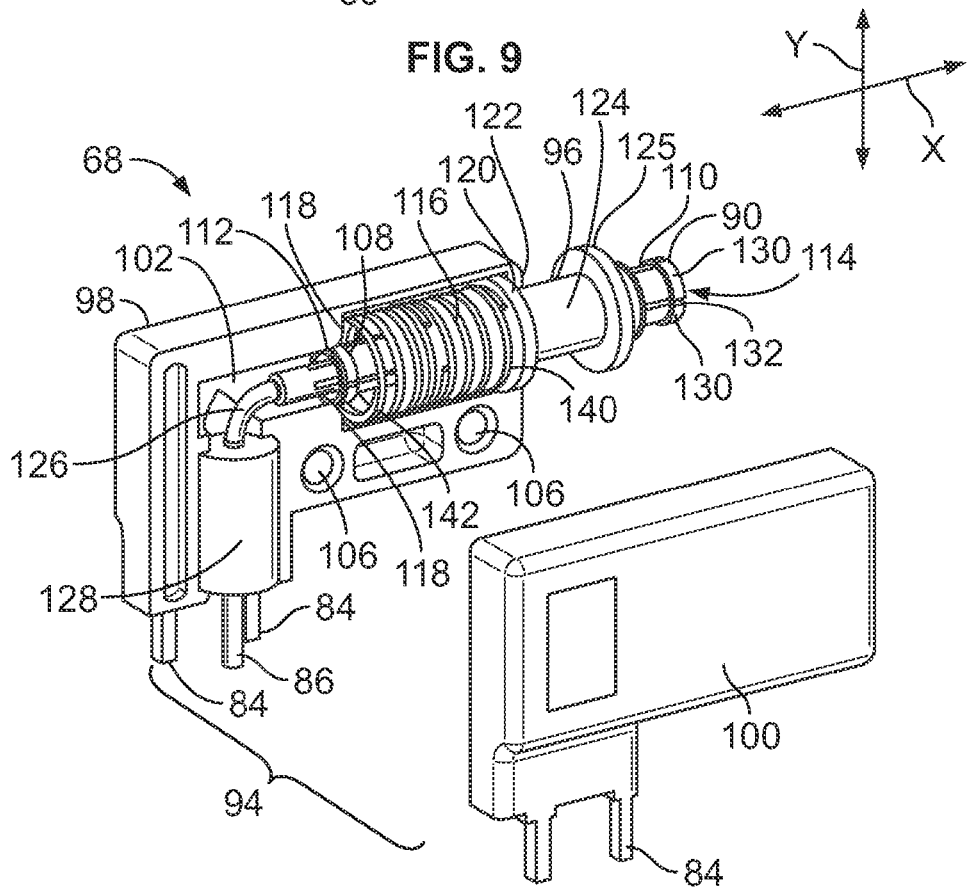
FIG. 10 illustrates a partially-exploded view of a contact insert from a second side, according to an embodiment.

As explained with respect to FIGS. 9 and 10, each contact insert 68 includes a separable shielding body 94 that securely retains an RF contact. The separable shielding body 94 allows for easy and reliable manufacturing in that the shielding body 94 is merely opened or separated, an RF contact 96 is inserted therein, and the separated shielding body 94 is then closed or reformed with at least a portion of the RF contact 96 securely retained therein.

FIGS. 9 and 10 illustrate a partially-exploded view of a contact insert 68 from first and second sides, respectively, according to an embodiment. Referring to FIGS. 9 and 10, the contact insert 68 includes a separable shielding body 94 that retains an RF contact 96. The shielding body 94 includes symmetrical body halves or members 98 and 100, which may be mirror-images of each other about a central vertical plane of the shielding body 94 that is parallel to an X-Y plane. The mirror-image, symmetrical body halves or members 98 and 100 provide for reliable and easily-distinguishable components that are easily manipulated, which leads to a more efficient manufacturing process.

The body halves or members 98 and 100 are configured to secure to one another, such as through a snap-fit, latching, interference fit, or the like connection, to form the shielding body 94. The body halves 98 and 100 are symmetrical about a longitudinal axis and/or plane (such as a plane parallel to a plane defined by the X and Y axes shown in FIGS. 9 and 10) of the shielding body 94. Each body half 98 and 100 includes a half-channel 102 configured to receive and retain the RF contact 96. When the body halves or members 98 and 100 are connected to one another, the half-channels 102 form an RF contact channel that securely retains the RF contact 96. The body halves 98 and 100 form a mirror-image, symmetrical, clam-shell-like housing that retains the RF contact 96. Optionally, the body halves 98 and 100 may be pivotally connected together through a integrally formed hinge.

In order to form the contact insert 68, the RF contact 96 is positioned in a half-channel 102 of one of the body halves 98 and 100, and the other body half 98 or 100 is then aligned and snapably secured to the mirror image body half 98 or 100. As shown in FIG. 9, the body half 100 may include snap posts 104 configured to be snapably retained within reciprocal openings 106 formed in the other half 98. Alternatively, the body half 98 may include the snap posts 104 and the body half 100 may include the openings 106. Also, alternatively, instead of a snap-fit connection, the body halves 98 and 100 may be configured to latchably or otherwise removably connect to one another. The body halves 98 and 100 may be secured together to securely retain the RF contact 96 therein. The body halves 98 and 100 may later be separated to remove the RF contact 96 if it is malfunctioning, and a new RF contact 96 may replace the malfunctioning RF contact 96. Therefore, not only are the contact inserts 68 interchangeable with respect to the grounding block 66 (shown in FIGS. 7 and 8, for example), the RF contacts 96 are interchangeable with respect to the shielding bodies 94, due to the separable nature of the shielding bodies 94.

As shown, the contact insert 68 provides a right angle connection. That is, the mating tip 90 of the RF contact 96 extends along a direction that is parallel to the axis X, while the signal tail 86 extends along a direction that is parallel to the axis Y, which is orthogonal to the axis X.

Referring to FIG. 10, in particular, the RF contact 96 includes a shell 108 between a mating end 110 and a lead end 112. The shell 108 defines a shell cavity 114. The RF contact 96 includes a center contact pin (hidden from view in FIGS. 9 and 10) held within the shell cavity 114. A dielectric body (not shown in FIGS. 9 and 10) may be positioned between the shell 108 and the center contact pin. The shell 108 may be formed from a conductive material, such as a metal material, and the dielectric body electrically separates the center contact and the shell 108. The RF contact 96 also includes a coil spring 116 concentrically surrounding a portion of the shell 108. The coil spring 116 is biased between an internal wall 118 defined within each body half 98 and 100 and a flange 120 of the RF contact 96.

The shell 108 may be cylindrical in shape. The flange 120 extends radially outward from the shell 108. The flange 120 is positioned proximate the mating end 110 and abuts into a clasping ledge 122 defined by the body halves 98 and 100. An extension tube 124 extends out of the shielding body 94 past the clasping ledge 122. The shielding body 94 connects to a mating flange 125 proximate the mating tip 90. The mating flange 125 is spaced from the flange 120 by the extension tube 124.

The lead end 112 connects to a flexible lead 126 that bends downwardly at a right angle from the shell 108 and toward a bottom of the contact insert 68. At least a portion of the flexible lead 126 is surrounded by a dielectric cylinder 128 that may be formed of Teflon, for example, and is configured to isolate signals passing through the flexible lead 126 from neighboring signals. The flexible lead 126 terminates at the signal tail 86 that extends from a bottom of the contact insert 68. When the body halves 98 and 100 are connected together, the signal tail 86 is centered between the four grounding tails 84 formed and defined by the body halves 98 and 100.

The mating tip 90 includes a plurality of segments 130 that are separated by gaps 132. The segments 130 are movable with respect to one another such that the segments 132 may be deflected toward one another to reduce the diameter of the mating tip 90 when mated with a reciprocal backplane contact, such as the backplane contacts 34 shown in FIG. 1. Deflection of the segments 130 may cause a friction fit when mated with the backplane contacts 34.

The spring 116 has a helically wound body extending between a front end 140 and a rear end 142. The rear end 142 abuts the internal wall 118 of the contact insert 68, while the front end 140 abuts the flange 120. The spring 116 has a spring diameter that is greater than the diameter of the shell 108. The spring 116 is compressible axially.

Figure 11:
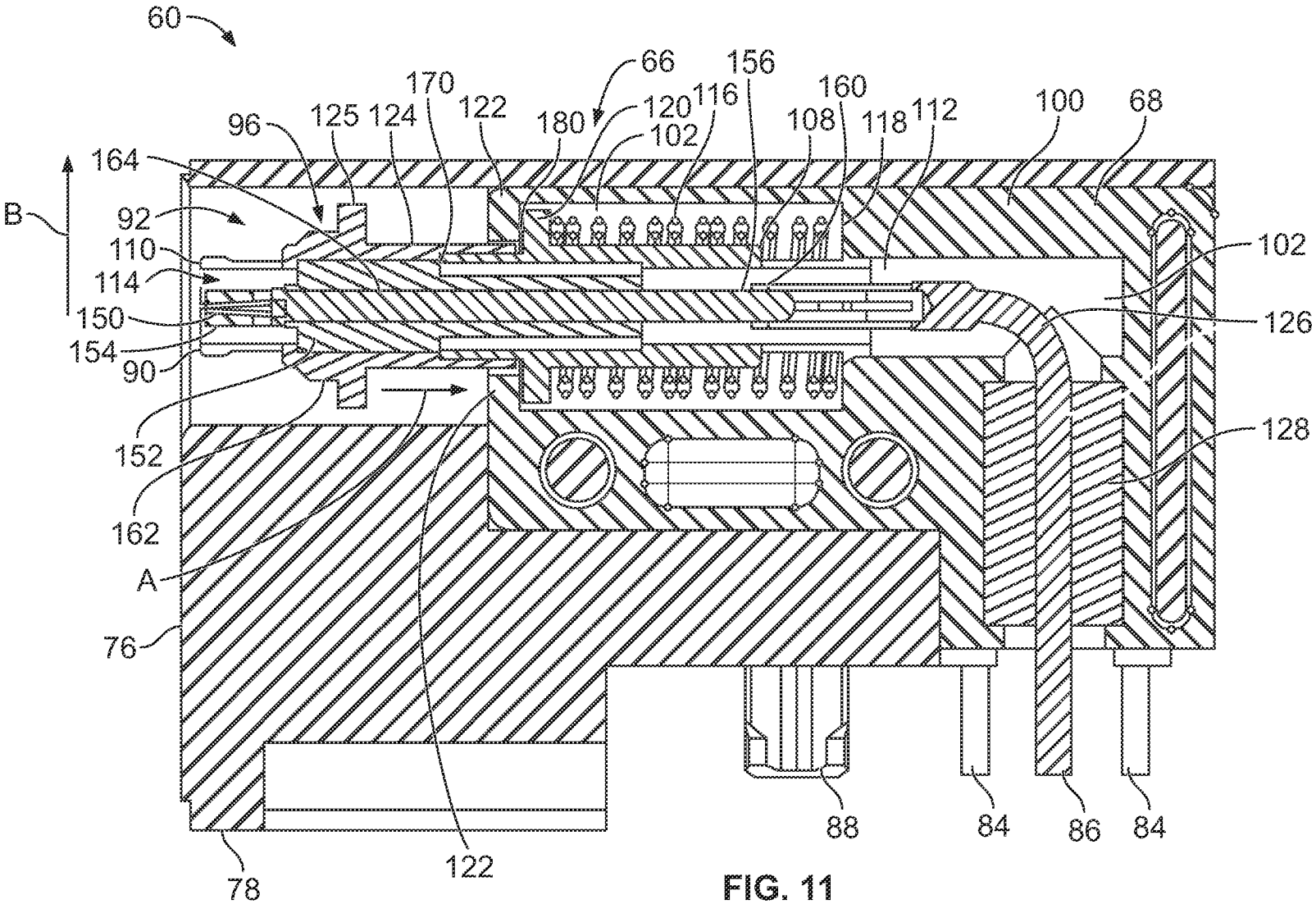
FIG. 11 illustrates an internal cross-sectional of an RF module through line 11-11 of FIG. 5, according to an embodiment.

FIG. 11 illustrates an internal cross-sectional of the RF module 60 through line 11-11 of FIG. 5, according to an embodiment. As noted above, the RF contact 96 includes a center contact pin 150 held within the shell cavity 114. A dielectric body 152 may be positioned between the shell 108 and the center contact pin 150.

The center contact pin 150 includes a mating end 154 and a lead end 156. The mating end 154 extends in the mating tip 90 and is configured to mate with a reciprocal contact of a backplane contact. The lead end 156 is slidably retained within a pin-receiving tube 160 extending from the lead 126. The pin-receiving tube 160 slidably retains the lead end 156 while maintaining contact therewith. Accordingly, a connecting interface is established between the center contact pin 150 and the lead 126 that allows RF signals to pass therebetween. Optionally, instead of a pin-receiving tube 160, the lead 126 may include opposed prongs, spring members, or the like that slidably retain the lead end 156 of the center contact pin 150.

The shell 108 includes a mating shell portion 162 connected to an internal portion 164 within the channel 102 defined by the halves 98 and 100. As pressure is exerted into the mating tip 90 of the RF contact 96 in the direction of arrow A, the extension tube 124 and/or the dielectric body 152 exerts an equal pressure into a proximal edge 170 of the internal portion 164, thereby forcing the flange 120 in the same direction within the channel 102. As the flange 120 moves in the direction of arrow A, the flange 120 axially compresses the coil spring 116 against the internal wall 118 of the contact insert 68. The coil spring 116 exerts an equal, but opposite, force into the flange 120. During this time, the lead end 156 of the center contact pin 150 slides further into the pin-receiving tube 160. Once the pressure in the direction of arrow A ceases, the spring 116 expands back to its at-rest position, thereby pushing the flange 120 back against the clasping ledge 122. In this manner, the RF contact 96 may shift axially in the direction of arrow A to accommodate varying mating forces. The signal tail 86 may be secured to the daughtercard 14 (shown in FIG. 1), but is not pushed or moved, due to the clearance within the pin-receiving tube 160. That is, while the center contact pin 150 slides within the pin-receiving tube 160, the pin-receiving tube 160 remains stationary and fixed, thereby ensuring that the connection between the signal tail 86 and the daughterboard 14 (such as through a soldered connection) is not compromised.

The flange 125 is prevented from passing into the channel 102 by the clasping ledge 122 because the diameter of the flange 125 is greater than the opening 180 formed through the clasping ledge 122. Therefore, the distance of axial movement of the center contact pin 150 is limited. Once the flange 125 abuts the clasping ledge 122, the axial movement of the center contact pin 150 is stopped, thereby ensuring that the lead end 156 does not push past the pin-receiving tube 160 into an internal barrier wall of the lead 126. The distance between the flange 125 and the clasping ledge 122 provide an axial float area through which the center contact pin 150 may axially move in order to accommodate variable mating distances and/or forces.

Additionally, the opening or space 180 through which extension tube 124 passes has a larger diameter than the extension tube 124, which provides a clearance gap or space between shaft of the extension tube 124 and the edge of the clasping ledge 122 that defines the opening or space 180. Accordingly, the extension tube 124 may radially shift in the directions of arrows B, in order to accommodate a mating connection that may not be in perfect alignment. Thus, the space between the extension tube 124 and the edges of the clasping ledge 122 that define the opening 180 provide a radial float area through which the center contact pin 150 may radially move.

Figure 12:
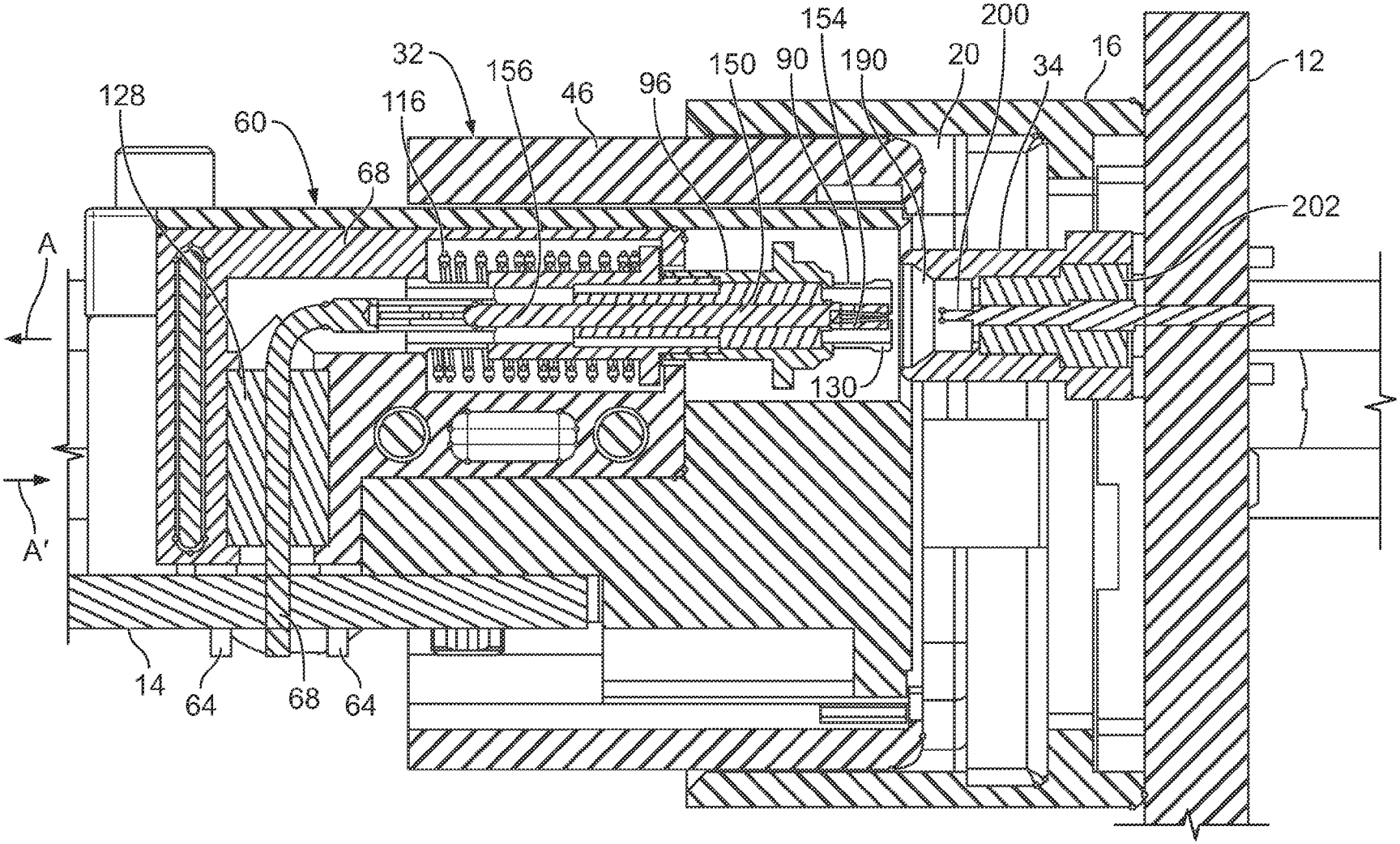
FIG. 12 illustrates an internal cross-sectional view of an RF module being mated to a mating contact extending from a backplane, according to an embodiment.

FIG. 12 illustrates an internal cross-sectional view of an RF module 60 being mated to a mating contact 34 extending from the backplane 12, according to an embodiment. As shown in FIG. 12, the plug housing 46 of the module shell 32 is positioned within the internal cavity 20 of the shroud 16 and is urged in the direction of arrow A'. The mating tip 90 of the RF contact 96 is aligned with a reciprocal opening 190 of a backplane contact 34. The segments 130 of the mating tip 90 are configured to flexibly mate into the opening 190 so that the mating end 154 of the center contact pin 150 receives and mates with a pin 200 extending within the opening 190. As shown in FIG. 12, at least a portion of the pin 200 may be surrounded by a dielectric material 202.

During the initial alignment and mating of the RF module 60 and the contacts 34, the center contact pin 150 is fully-extended, and the coil spring 116 is also fully-extended and at-rest.

Figure 13:
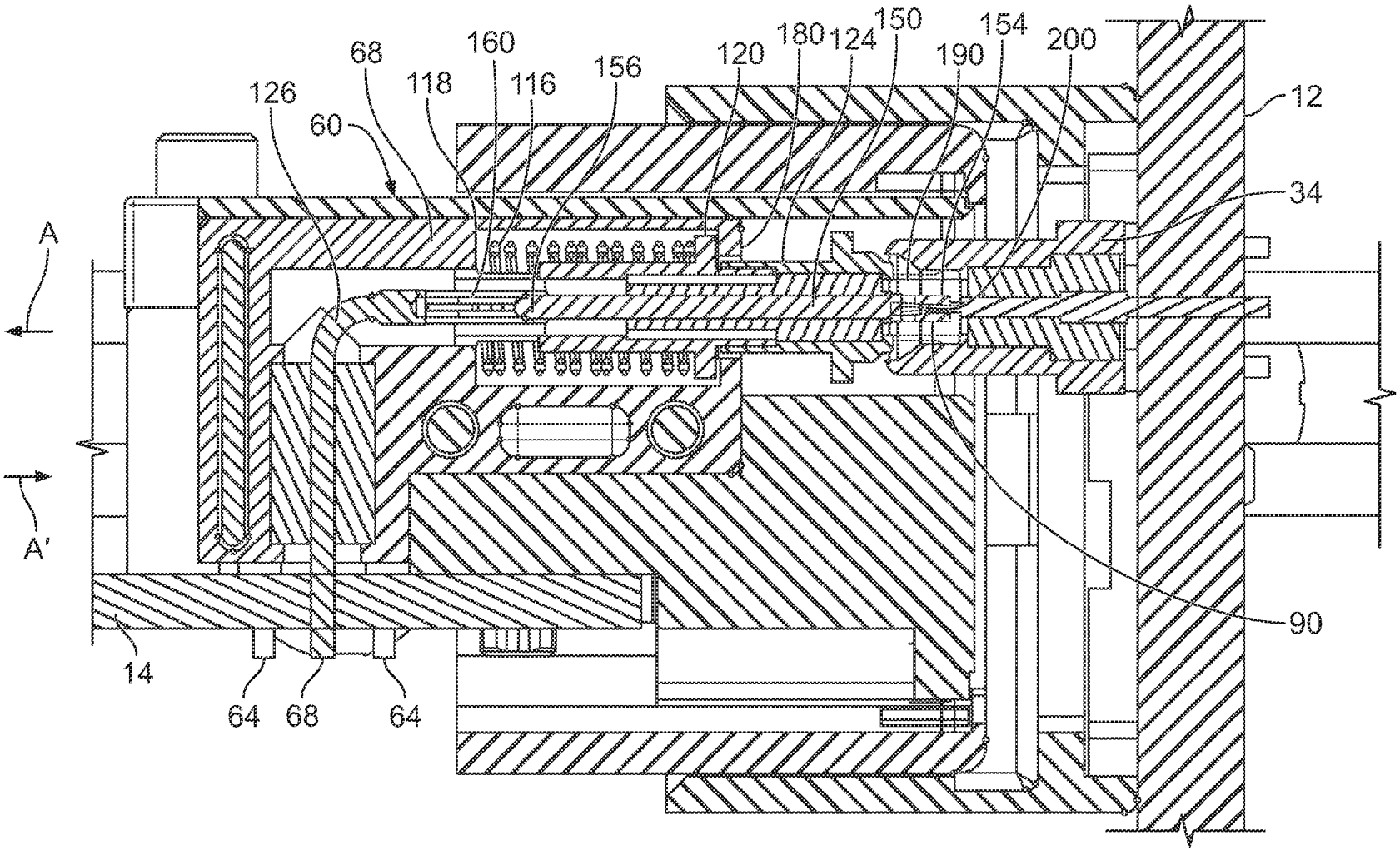
FIG. 13 illustrates an internal cross-sectional view of an RF module mated to a mating contact extending from a backplane, according to an embodiment.

FIG. 13 illustrates an internal cross-sectional view of the RF module 60 mated to the backplane contact 34 extending from the backplane 12, according to an embodiment. As the mating tip 90 is guided into the reciprocal opening 190 of the backplane contact 34, the mating tip 90 may shift due to the angled interface between it and the reciprocal opening 190. However, the radial float area defined between the space 180 and the extension tube 124 allows for the mating tip 90 to radially shift in order to be guided into a mating relationship in which the mating end 154 of the center contact pin 150 mateably retains the pin 200 of the backplane contact 34.

Additionally, as discussed above, with increased urging in the direction of arrow A', the flange 120 compresses the spring 116 against the internal wall 118, thereby compensating for the increased force in the direction of arrow A. In this manner, the spring 116 allows for axial float in the direction of arrow A, in which the lead end 156 of the center contact pin 150 slides within the pin-receiving tube 160. Therefore, the lead 126 having the signal tail 68 secured to the daughtercard 14 is protected from being bent, shifted, or otherwise moved relative to the daughtercard 14, which could otherwise damage the lead 126 and/or the connection between the lead 126 and the daughtercard 14.

Additionally, as shown in FIGS. 12 and 13, the RF module 60 connects the daughtercard 14 to the backplane 12 through a right angle connection without the use of cables between the RF module 60 and the backplane 12 and the daughtercard 14. The signal tail 68 connects to the daughtercard 14 through a signal via, for example, that may connect to electrical traces on or within the daughtercard 14. Similarly, the pin 200 of the backplane contact 34 connects to the backplane 12 through a via, for example, which may also connect to signal traces or within the backplane 12. As such, bulky cables do not extend out of the backplane 12 or the daughtercard 14 where the RF module 60 connects the backplane 12 to the daughtercard 14. Other modules may include cables, as shown in FIGS. 1, 12 and 13, for example, but the RF module 60 may be devoid of connecting cables.

Figure 14:
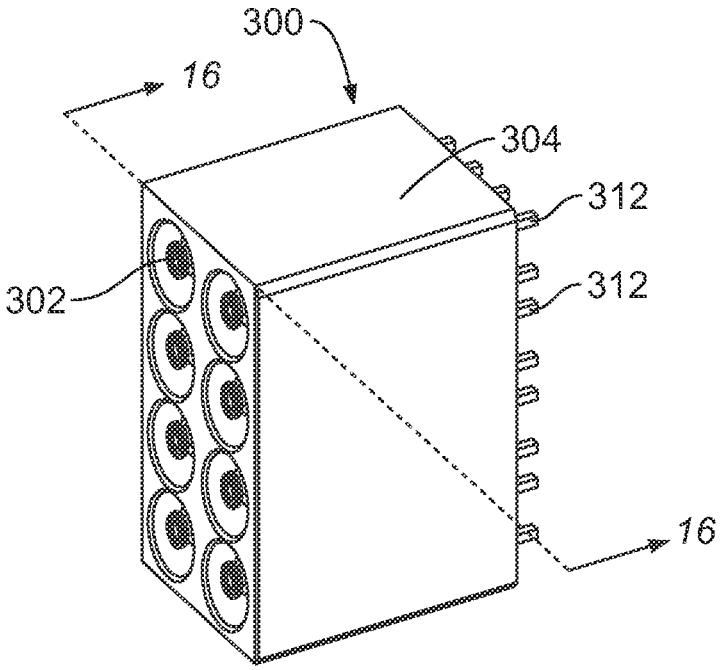
FIG. 14 illustrates a front isometric view of an RF module, according to an embodiment.
Figure 15:
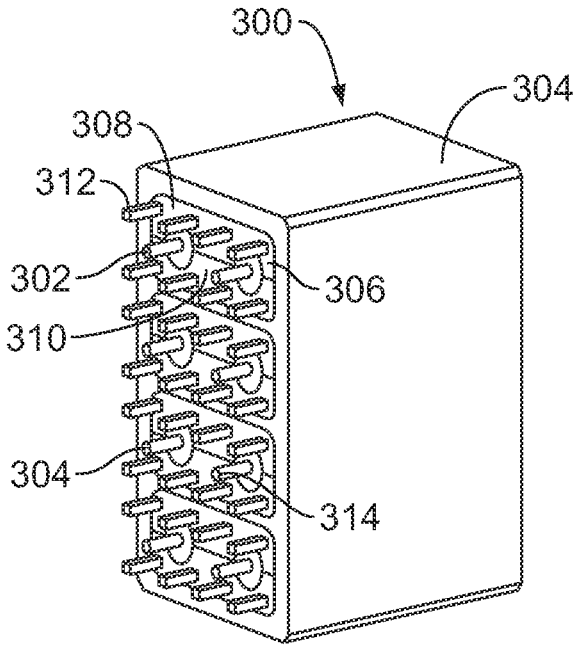
FIG. 15 illustrates a rear isometric view of an RF module, according to an embodiment.

FIG. 14 illustrates a front isometric view of an RF module 300, according to an embodiment. FIG. 15 illustrates a rear isometric view of the RF module 300, according to an embodiment. Referring to FIGS. 14 and 15, the RF module 300 is similar to the RF module 60 described above, except that the RF module 300 is a stacked or mezzanine RF module 300 having inserts 302 that are linearly aligned, as opposed to oriented at right angles. Each insert 302 is removably retained within a grounding block 304. Further, each insert 302 includes shielding bodies 306 that, in general, split each insert 302 in half lengthwise about a longitudinal axis. The body halves 308 and 310 may snap together and form grounding tails 312 positioned about central signal tails 314.

Figure 16:
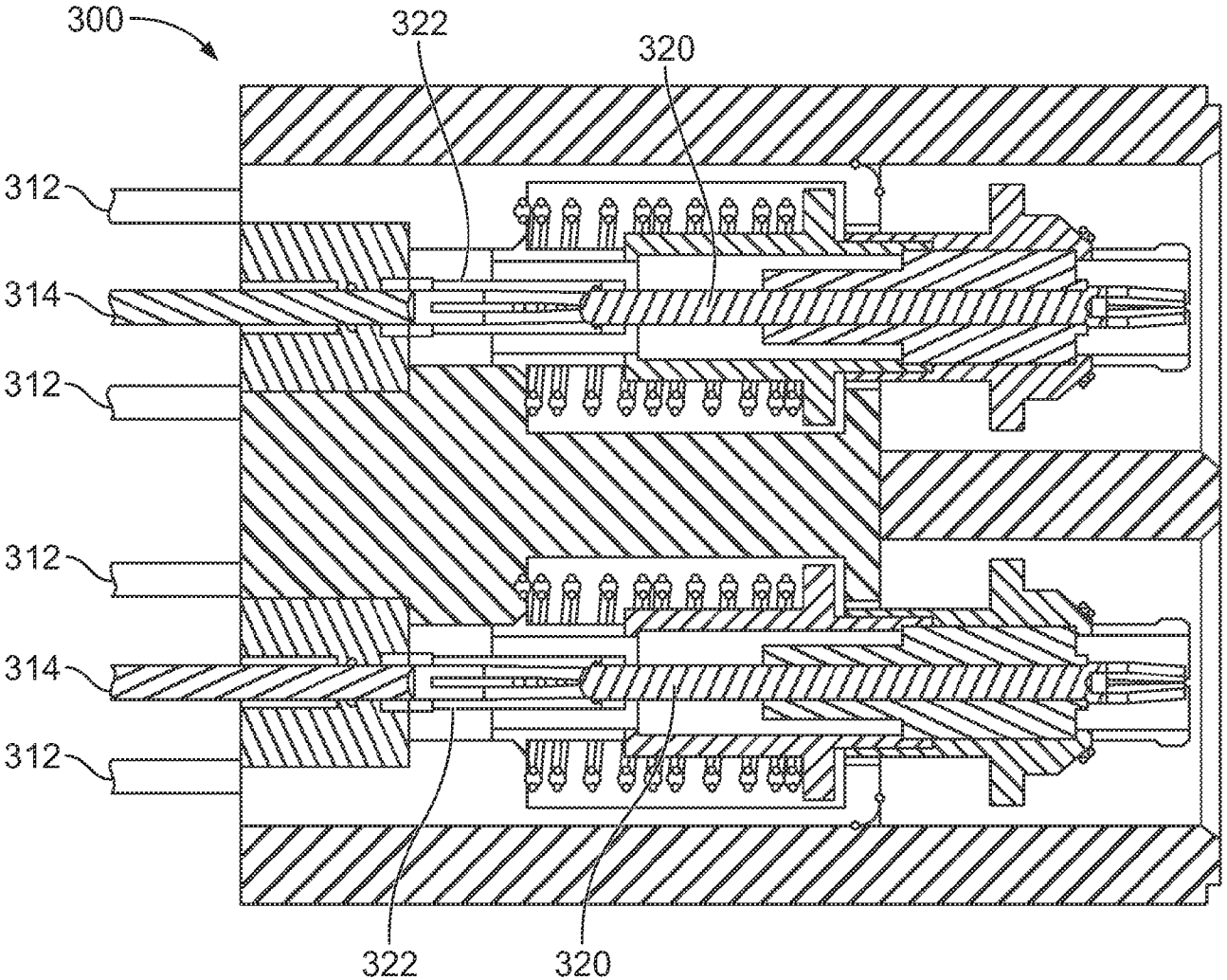
FIG. 16 illustrates an internal cross-sectional view of an RF module through line 16-16 of FIG. 14, according to an embodiment.

FIG. 16 illustrates an internal cross-sectional view of the RF module 300 through line 16-16 of FIG. 14, according to an embodiment. The RF module 300 includes a similar configuration as discussed above with respect to the RF module 60, except, instead of a right-angled lead, the center contact pins 320 are slidably retained by receiving tubes 322 that connect to the signal contacts 314 through a generally aligned linear connection.

Figure 17:
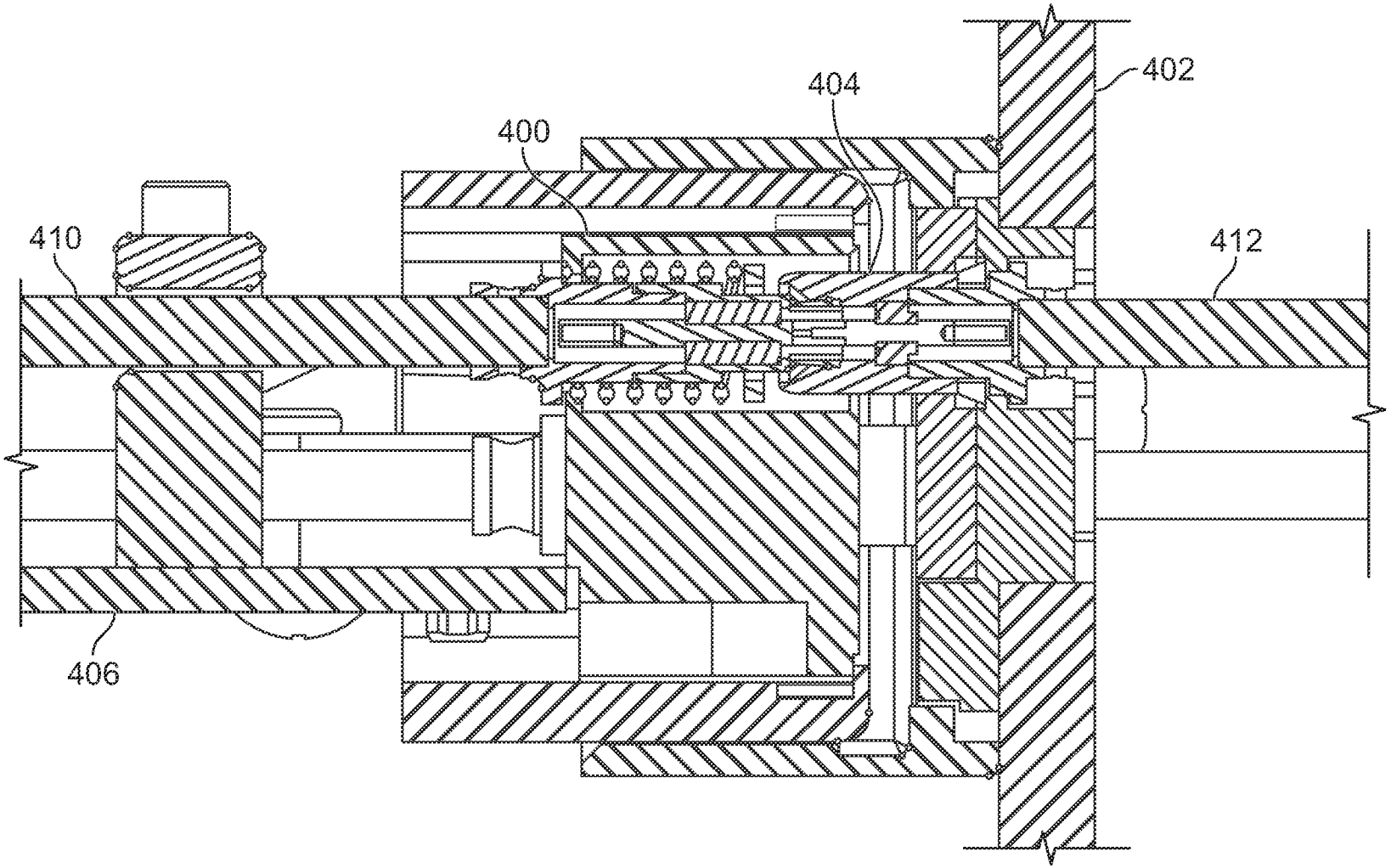
FIG. 17 illustrates a partial internal cross-sectional view of an RF module mated to a mating contact extending from a backplane, according to an embodiment.

FIG. 17 illustrates a partial internal cross-sectional view of an RF module 400 mated to a mating contact 402 extending from a backplane 404, according to an embodiment. The embodiment shown in FIG. 17 is similar to the embodiments described above, except that, instead of directly connecting to the backplane 404 and the daughtercard 406 through vias and traces, the RF module 400 may, alternatively, be connected to cables 410 and 412. Otherwise, the structure of the RF module 400 may be identical to RF module 60 or the RF module 300.

Referring to FIGS. 1-17, the RF modules include RF contacts that may receive jack contacts. The RF modules may be smooth bore receptacle contacts or may be full detent receptacle contacts. The RF modules may be right angle connectors or straight connectors terminated to the backplane circuit board. The RF modules may be terminated to ends of cables rather than directly to the backplane circuit board in other embodiments.

Thus, embodiments provide an RF module that may be used in an electrical connector system. Embodiments may provide space-savings by directly connecting a backplane to a daughtercard with an RF module without the use of bulky, bent, and routed cables. Optionally, embodiments may provide an RF module that may connect cables to one another. Embodiments provide RF modules that may be right-angle connectors or in-line mezzanine connectors.

Embodiments provide an easy-to-assemble RF module that may include a separable body. The separable body may be split into halves about a central plane and/or longitudinal axis. As such, the RF module may include symmetrical, mirror image body halves that may be opened to allow an RF contact to be positioned therein, and then the body halves may be secured together, such as through a snap-fit. As such, embodiments provide an RF module that is easier to assemble than previously-known modules.

Additionally, embodiments provide an RF module in which contact inserts may be interchanged. Therefore, a malfunctioning contact insert may be quickly and easily replaced.

Embodiments provide an RF module that allows for axial and radial float, thereby providing easier and more consistent mating, even if the mating components are not perfectly aligned.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein". Moreover, in the following claims, the terms "first", "second", and "third", etc. are used merely as labels, and are not intended to impose numerical requirements on their objects. Further, the limitations of the following claims are not written in means–plus-function format and are not intended to be interpreted based on 35 U.S.C. §112, sixth paragraph, unless and until such claim limitations expressly use the phrase "means for" followed by a statement of function void of further structure.

What is claimed is:

1. An RF module comprising:

a grounding block including a front mating face, a rear wall, and a base, the front mating face having at least one contact mating cavity formed therein, the rear wall having an insert- retaining channel formed therethrough; and a contact insert removably secured within the grounding block, the contact insert having a shielding body retaining an RF contact, wherein the RF contact comprises: (i) a center contact pin slidably connected to a lead, (ii) a compressible coil spring biased within the contact insert, wherein the compressible coil spring allows for the center contact pin to axially adjust with respect to the lead in response to varying mating distances, and (iii) an RF mating tip connected to a signal tail, the mating tip and the signal tail extending out of the shielding body, wherein the contact insert is positioned within the grounding block through the rear wall such that the RF mating tip extends into the contact mating cavity and the signal tail extends from the base, and wherein the contact insert may be removed from the grounding block.

2. The RF module of claim 1, wherein the shielding body is separable.

3. The RF module of claim 2, wherein the shielding body is separable about a central longitudinal plane.

4. The RF module of claim 1, wherein the shielding body comprises first and second body halves, and wherein the RF contact is positioned within the first body half and the second body half is snapably secured to the second body half.

5. The RF module of claim 4, wherein the first body half is a symmetrical mirror image of the second body half.

6. The RF module of claim 1, wherein the center contact pin is configured to axially adjust with respect to the lead while the lead remains stationary.

7. The RF module of claim 1, wherein the contact insert is a right-angle contact insert.

8. The RF module of claim 1, wherein the contact insert is an aligned linear contact insert.

9. The RF module of claim 1, wherein the RF contact is retained within the contact insert by a clasping ledge having an opening larger than a portion of the RF contact, wherein a space between the RF contact and the clasping ledge allows the RF contact to radially shift within the contact insert.

10. The RF module of claim 1, wherein the base is configured to secure to a daughtercard and the mating tip is configured to mate with a backplane contact without cables.

11. The RF module of claim 1, wherein the contact insert is configured to connect to at least one cable.

12. An RF module comprising:

a contact insert having a separable shielding body retaining an RF contact, wherein the RF contact comprises: (i) a center contact pin slidably connected to a lead, (ii) a compressible coil spring biased within the contact insert, wherein the compressible coil spring allows for the center contact pin to axially adjust with respect to the lead in response to varying mating distances, and (iii) an RF mating tip connected to a signal tail, the mating tip and the signal tail extending out of the shielding body, wherein the shielding body comprises separable first and second body members, wherein the first body member and the second body member are removably secured to one another, and wherein at least a portion of the RF contact is contained within an internal channel defined between the first and second body members.

13. The RF module of claim 12, further comprising a grounding block, wherein the contact insert is removably secured within the grounding block.

14. The RF module of claim 12, wherein the shielding body is separable about a central longitudinal plane so that the first body member is a symmetrical mirror image of the second body member.

15. The RF module of claim 12, wherein the center contact pin is configured to axially adjust with respect to the lead while the lead remains stationary.

16. The RF module of claim 12, wherein the contact insert is a right-angle contact insert.

17. The RF module of claim 12, wherein the contact insert is an aligned linear contact insert.

18. The RF module of claim 12, wherein the RF contact is retained within the contact insert by a clasping ledge having an opening larger than a portion of the RF contact, wherein a space between the RF contact and the clasping ledge allows the RF contact to radially shift within the contact insert.

19. An RF module comprising:

a grounding block including a front mating face, a rear wall, and a base, the front mating face having at least one contact mating cavity formed therein, the rear wall having an insert- retaining channel formed therethrough; and a contact insert removably secured within the grounding block, the contact insert having a shielding body retaining an RF contact, the RF contact having an RF mating tip connected to a signal tail, the mating tip and the signal tail extending out of the shielding body, wherein the RF contact is retained within the contact insert by a clasping ledge having an opening larger than a portion of the RF contact, wherein a space between the RF contact and the clasping ledge allows the RF contact to radially shift within the contact insert, wherein the contact insert is positioned within the grounding block through the rear wall such that the RF mating tip extends into the contact mating cavity and the signal tail extends from the base, and wherein the contact insert may be removed from the grounding block.

20. An RF module comprising:

a contact insert having a separable shielding body retaining an RF contact, the RF contact having an RF mating tip connected to a signal tail, the mating tip and the signal tail extending out of the shielding body, wherein the RF contact is retained within the contact insert by a clasping ledge having an opening larger than a portion of the RF contact, wherein a space between the RF contact and the clasping ledge allows the RF contact to radially shift within the contact insert wherein the shielding body comprises separable first and second body members, wherein the first body member and the second body member are removably secured to one another, and wherein at least a portion of the RF contact is contained within an internal channel defined between the first and second body members.

21. An RF module comprising:

a grounding block including a front mating face, a rear wall, and a base, the front mating face having a plurality of contact mating cavities formed therein, the rear wall having a plurality of insert-retaining channels formed therethrough; and a plurality of contact inserts removably secured within the grounding block, each of the plurality of contact inserts having a shielding body retaining an RF contact, the RF contact having an RF mating tip connected to a signal tail, the mating tip and the signal tail extending out of the shielding body, wherein each of the plurality of contact inserts is positioned within the grounding block through a respective one of the plurality of insert-retaining channels formed through the rear wall such that a respective RF mating tip extends into one of the plurality of contact mating cavities and a respective signal tail extends from the base, and wherein each of the plurality of contact inserts may be removed from the grounding block.

* * * * *